US008035321B2

(12) United States Patent
Chen et al.

(10) Patent No.: US 8,035,321 B2
(45) Date of Patent: Oct. 11, 2011

(54) INJECTOR FOR BETATRON

(75) Inventors: Felix Chen, Newtown, CT (US); Christian Stoller, Princeton Junction, NJ (US); Olivier Philip, Ewing, NJ (US); Luke T. Perkins, Plainsboro, NJ (US)

(73) Assignee: Schlumberger Technology Corporation, Cambridge, MA (US)

( * ) Notice: Subject to any disclaimer, the term of this patent is extended or adjusted under 35 U.S.C. 154(b) by 776 days.

(21) Appl. No.: 11/957,257

(22) Filed: Dec. 14, 2007

(65) Prior Publication Data

US 2009/0153011 A1 Jun. 18, 2009

(51) Int. Cl.
*H05H 11/00* (2006.01)

(52) U.S. Cl. ..... 315/504; 315/505; 315/507

(58) Field of Classification Search ..... 315/500–507; 313/303, 309, 414
See application file for complete search history.

(56) References Cited

U.S. PATENT DOCUMENTS

| | | | | | |
|---|---|---|---|---|---|
| 2,533,859 | A | * | 12/1950 | Wideroe | 315/504 |
| 2,586,494 | A | * | 2/1952 | Wideroe | 315/501 |
| 2,825,833 | A | * | 3/1958 | Yanagisawa et al. | 313/62 |
| 3,321,625 | A | | 5/1967 | Wahl | |
| 3,975,689 | A | | 8/1976 | Geizer et al. | |
| 3,996,473 | A | | 12/1976 | Culver | |
| 4,577,156 | A | | 3/1986 | Kerst | |
| 4,823,044 | A | | 4/1989 | Falce | |
| 5,077,530 | A | | 12/1991 | Chen | |
| 5,122,662 | A | | 6/1992 | Chen et al. | |
| 5,202,604 | A | * | 4/1993 | Kweon | 313/414 |
| 5,293,410 | A | | 3/1994 | Chen et al. | |
| 5,319,314 | A | | 6/1994 | Chen | |
| 5,426,409 | A | | 6/1995 | Johnson | |
| 5,525,797 | A | | 6/1996 | Moake | |
| 5,600,213 | A | * | 2/1997 | Hiramoto et al. | 315/507 |
| 5,680,018 | A | * | 10/1997 | Yamada | 315/500 |
| 5,717,204 | A | * | 2/1998 | Meisburger et al. | 250/310 |
| 5,745,536 | A | | 4/1998 | Brainard et al. | |
| 5,804,820 | A | | 9/1998 | Evans et al. | |
| 5,912,460 | A | | 6/1999 | Stoller et al. | |
| 6,121,850 | A | | 9/2000 | Ghoshal | |
| 6,201,851 | B1 | | 3/2001 | Piestrup et al. | |
| 6,441,569 | B1 | | 8/2002 | Janzow | |
| 6,713,976 | B1 | | 3/2004 | Zumoto et al. | |
| 6,925,137 | B1 | | 8/2005 | Forman | |

(Continued)

OTHER PUBLICATIONS

Ellis et al., Well Logging for Earth Scientists, Springer, 2nd edition, 2007, pp. 345-379.

*Primary Examiner* — Douglas W Owens
*Assistant Examiner* — Tung X Le
(74) *Attorney, Agent, or Firm* — Rachel E. Greene; Brigid Laffey

(57) ABSTRACT

An electron acceleration portion of a Betatron having a vacuum chamber with an interior wall spaced from an exterior wall with a main electron orbit located approximate to the exterior wall and the interior wall. An electron injector has an anode structured and arranged adjacent a wall selected from the group consisting of the interior wall and the exterior wall that is shaped so as to not impede the main electron orbit. There is at least one electron deflection plate disposed approximate an anode end of the anode and the main electron orbit. There can be two electron deflection plates spaced apart that form a gap of a width effective to receive emitted electrons from the electron injector. Such that, there is a voltage potential between the two electron deflection plates that is effective to deflect emitted electrons towards the main electron orbit.

25 Claims, 5 Drawing Sheets

U.S. PATENT DOCUMENTS 7,148,613 B2 12/2006 Dally et al.
2001/0050525 A1* 12/2001 Cho et al. ..... 313/414
2006/0261759 A1 11/2006 Chen et al.
2009/0267543 A1* 10/2009 Bermuth et al. ..... 315/504

* cited by examiner

INJECTOR FOR BETATRON

BACKGROUND OF THE INVENTION

1. Field of the Invention

The invention is generally related to circular electron accelerators. More particularly, a combination of an internal electron injector and electrostatic deflection electrodes enhances the number of injected electrons that enter a main electron orbit of a Betatron and are accelerated to relativistic velocity.

2. Background of the Invention

Oil well bore hole logging is a process by which properties of earth strata as a function of depth in the bore hole are measured. A geologist reviewing the logging data can determine the depths at which oil containing formations are most likely located. Most present day well logging relies on gamma-rays obtained from chemical radiation sources to determine the bulk density of the formation surrounding a borehole. These sources pose a radiation hazard and require strict controls to prevent accidental exposure or intentional misuse. In addition, most sources have a long half life and disposal is a significant issue. For some logging applications, in particular determination of formation density, a $^{137}Cs$ source or a $^{60}Co$ source is used to irradiate the formation. The intensity and penetrating nature of the radiation allow a rapid, accurate, measurement of the formation density. In view of the problems with chemical radiation sources, it is important that chemical radiation sources be replaced by electronic radiation sources. The main advantage of the latter is that they can be switched off, when no measurement is made and that they have at most a very minimal potential for intentional misuse.

One proposed replacement for chemical gamma-ray sources is a Betatron accelerator. In this device, electrons are accelerated on a circular path by a varying magnetic field until being directed onto a target. The interaction of the electrons with the target leads to the emission of Bremsstrahlung and characteristic x-rays of the target material. Before electrons can be accelerated, they are injected into a magnetic field between two circular pole faces at the right time, with correct energy and correct angle. Control over timing, energy and injection angle enables maximizing the number of electrons accepted into a main electron orbit and accelerated.

In a typical Betatron, electrons are accelerated in a circular orbit by the EMF (electromotive force) induced by an increasing magnetic field. This requires that electrons be injected at the correct angle and energy at the right time. The injection angle is critical for optimal injection and needs to be controlled to better than one degree. Injection angle is typically controlled by proper alignment and positioning of an electron ejector. The injection angle can be fairly easily controlled in large Betatrons, i.e. with a circular magnetic field of 4.5 inches in diameter or larger, through the use of an external electron injector. One such external electron injector is disclosed in U.S. Pat. No. 6,713,976 to Zumoto, et al.

Large Betatrons are suitable for applications where size constraints are not critical, such as to generate x-rays for medical radiation purposes. However, in applications such as oil well bore holes where there are severe size constraints, it is desired to use smaller Betatrons, typically with a magnetic field diameter of 3 inches or less. With this size constraint, an external electron injector is not practical and a Betatron with an internal electron gun and injector is preferred. An internal injector is mounted inside the main vacuum chamber in close proximity to the electron orbit. One such Betatron is disclosed in U.S. Pat. No. 6,201,851 to Piestrup, et al. With an internal injector, accurate control of the injection angle becomes more difficult and adjustments after sealing the vacuum chamber are difficult or impossible. In addition to the cathode and an anode, an internal injector may include additional electrodes such as grids for improved electron extraction, pulsing and/or focusing or other electrodes required for improved electron optics. However, the direction of the beam exiting the injector is fixed and given by the geometry of the electron gun and the magnetic field.

U.S. Pat. Nos. 6,201,851 and 6,713,976 are incorporated by reference in their entireties herein.

There remains a need for an internal electron gun and injector having better control over the injection angle of electrons for use in a betatron having application for down hole well bore applications.

SUMMARY OF THE INVENTION

According to an embodiment of the invention, the invention can have an electron acceleration portion of a Betatron including a vacuum chamber with an interior wall spaced from an exterior wall with a main electron orbit located between the exterior wall and the interior wall. The above-noted embodiment further includes an electron injector having an anode structured and arranged adjacent a wall selected from the group consisting of the interior wall and the exterior wall that is shaped so as to not impede the main electron orbit. Further, at least one electron deflection plate is disposed approximate an anode end of the anode and the main electron orbit.

According to an aspect of the invention, the invention can have a first electron deflection plate and a second electron deflection plate that are spaced apart from each other by a gap effective to receive emitted electrons from the electron injector.

Further, according to another aspect of the invention, the invention can include a voltage potential between the first electron deflection plate and the second electron deflection plate that is effective to deflect the emitted electrons toward the main electron orbit. It is also possible the voltage potential can be constant at about 2 volts to about ±500 volts and be adjustable to effectively obtain an optimal average injection angle.

According to an aspect of the invention, both the first electron deflection plate and the second electron deflection plate can be electrically isolated from the anode. Further, one of the first electron deflection plate and the second electron deflection plate can be electrically coupled to the anode. Further still, the anode of the electron injector to which the second deflection plate is electrically coupled can be electrically coupled to ground.

According to another embodiment of the invention, the invention has an electron acceleration portion of Betatron including a vacuum chamber having an interior wall spaced from an exterior wall with a main electron orbit located between the exterior wall and the interior wall. The above-noted embodiment further includes an electron injector adjacent one of the interior wall and the exterior wall and shaped so as to not impede the main electron orbit having an electron emitting cathode spaced from an anode. Further, the anode can have a first portion electrically isolated from a second portion with an opening effective to receive emitted electrons disposed therebetween.

According to an aspect of the invention, the invention may include a length of the first portion that is unequal to a length of the second portion of the anode. Further, the opening can be formed by one of a first front face of the first portion and a second front face of the second portion of the anode such that the opening is one of uniform or non-uniform in shape. It is possible, the opening shape can include one of a semicircular recess formed in one of the first front face and the second front face or a symmetric semicircular recesses formed in both the first front face and the second front face. Further still, a first distance between the first front face and the electron emitting cathode can be different from a second distance between the second front face and the electron emitting cathode. Also, the opening can have a non-uniform width along a length of the first front face and the second front face. Further, the opening may include a semicircular recess formed in one of the first front face and the second front face. Further still, the opening can include symmetric semicircular recesses formed in both the first front face and the second front face.

According to another embodiment of the invention, the invention has an electron acceleration portion of Betatron including a vacuum chamber having an interior wall spaced from an exterior wall and a top wall and a bottom wall with a main electron orbit located between the exterior wall and the interior wall and between the top wall and the bottom wall. The above-noted embodiment further includes an electron injector having an electron emitting cathode spaced from an anode, such that the electron injector can be structured and arranged adjacent one of the top wall and the bottom wall and shaped so as to not impede the main electron orbit. Further, at least one electron deflection plate can be disposed approximate an anode end of the anode and the main electron orbit.

According to an aspect of the invention, the invention may include at least one electron deflector plate that can be arranged so as to deflect an injected beam in the vertical direction to reach an optimal orbit. Further, the at least one electron deflector plate can be arranged so as to deflect an injected beam in the horizontal direction to reach an optimal orbit.

According to an aspect of the invention, the invention may include one of the anode or the electron emitting cathode integrated into one of a surface of the top wall or a surface of the bottom wall of the vacuum chamber and that can be electrically insulated from remaining surfaces of the vacuum chamber. It is possible, the anode and the electron emitting cathode can be located on an outside surface of the vacuum chamber. Further still, the anode and the electron emitting cathode can be located on an inside surface of the vacuum chamber.

According to an aspect of the invention, the invention may include one of the anode or the electron emitting cathode integrated into one of a surface of the interior wall or a surface of the exterior wall of the vacuum chamber and electrically insulated from remaining surfaces of the vacuum chamber. Further, the anode and the electron emitting cathode can be located on an outside surface of the vacuum chamber. Further still, the anode and the electron emitting cathode can be located on an inside surface of the vacuum chamber.

According to an aspect of the invention, the invention may include a first and a second electron deflector plate of the at least one electron deflector plate that has at least one curve. Further, the first electron deflector plate can be not identical to the second electron deflector plate.

Furthermore, it should be noted that the Betatron has a toroidal passageway disposed in a cyclical magnetic field varying between a maximum positive value and an opposite negative value with a main electron orbit circumnavigating the toroidal passage way. Thus, the vacuum chamber could be of any type of shape as long as not to impede the main electron orbit as described above.

Further features and advantages of the invention will become more readily apparent from the following detailed description when taken in conjunction with the accompanying Drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

According to an embodiment of the invention, the invention can have an electron acceleration portion of a Betatron including a vacuum chamber with an interior wall spaced from an exterior wall with a main electron orbit located between the exterior wall and the interior wall. The above-noted embodiment further includes an electron injector having an anode structured and arranged adjacent a wall selected from the group consisting of the interior wall and the exterior wall that is shaped so as to not impede the main electron orbit. Further, at least one electron deflection plate is disposed approximate an anode end of the anode and the main electron orbit.

According to an aspect of the invention, the invention can have an electron acceleration portion of a Betatron that has a torroidal electron track with an interior wall spaced apart from an exterior wall. Further, a main electron orbit can be located midway between or approximate to the exterior wall and the interior wall. Further, there can be at least one electron deflection plate disposed between an anode end of the electron injector and the main electron orbit.

Figure 1:
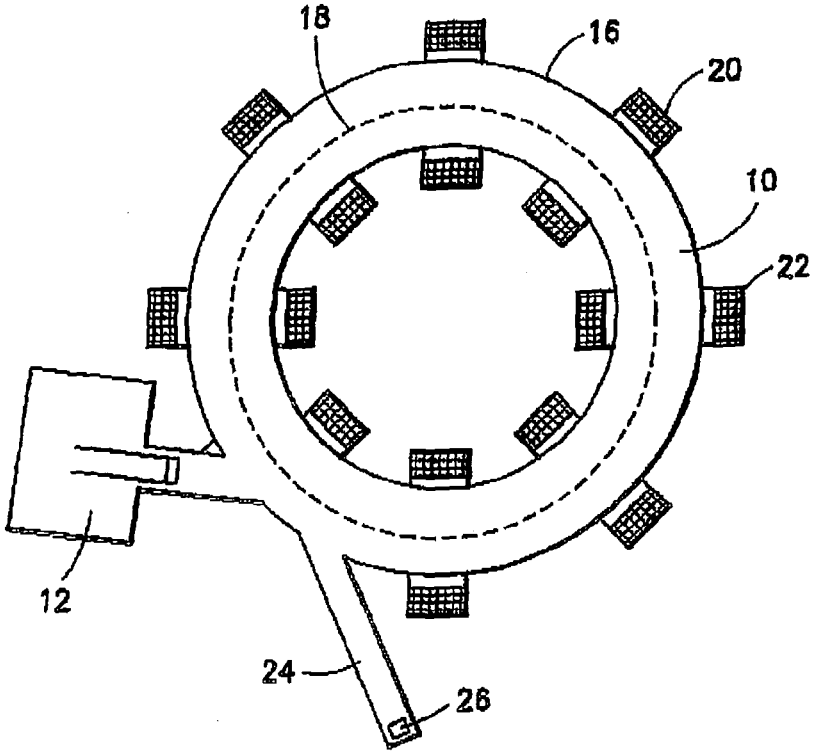
FIG. 1 PRIOR ART
FIG. 1 illustrates a Betatron toroid with an external electron injector as known from the prior art.
Figure 2:
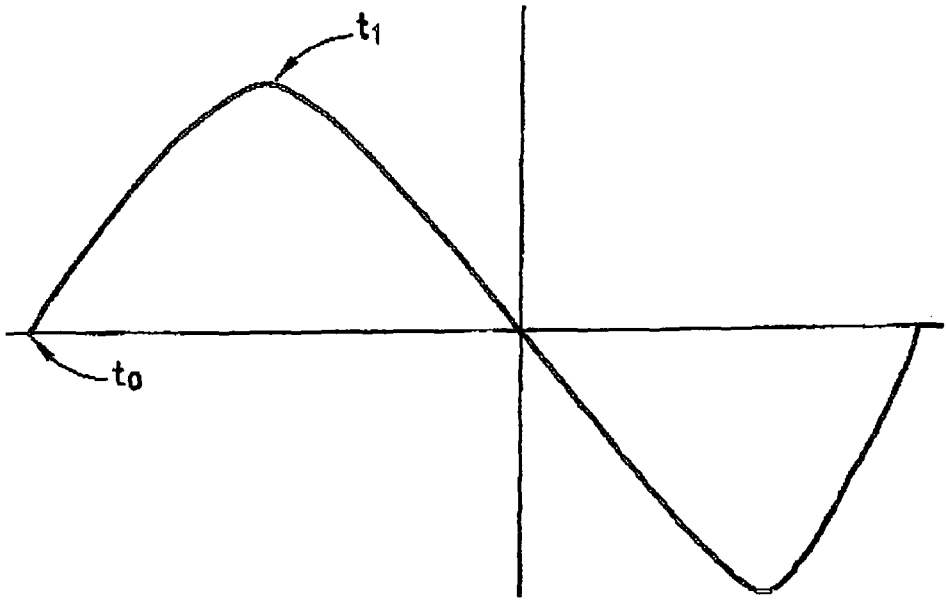
FIG. 2 PRIOR ART
FIG. 2 illustrates an alternating current cycle effective to accelerate electrons in the Betatron toroid of FIG. 1.

FIG. 1 illustrates a Betatron toroid 10 with an external electron injector 12 as known from the prior art. The Betatron toroid 10 is the electron acceleration portion of a Betatron. It includes a circular tube having an interior wall 14 spaced from an exterior wall 16 to define a circular passageway that is under a vacuum during operation. However, it is possible that the circular tube could be non-circular that defines a non-circular passageway that is under a vacuum during operation. Disposed midway between the interior wall 14 and the exterior wall 16 is a main electron orbit 18. The external electron injector 12 is aligned so that a maximum number of electrons emitted enter the main electron orbit 18. A plurality of magnetic coils 20 generate a magnetic flux in a magnetic core (not shown). The magnetic flux is increased at a controlled rate such as during the quarter cycle, $t_0$-$t_1$, of the representative alternating current cycle shown in FIG. 2. The increasing current from time $t_o$ time $t_1$ causes an increasing magnetic flux that accelerates electrons traveling along the main electron orbit 18 shown in FIG. 1. At the time of maximum magnetic flux, $t_1$, expansion/contraction coils 22 change the magnetic flux to draw the electrons away from main electron orbit 18 and into outlet 24. The electrons strike target 26 which is an x-ray generating metal or metal alloy, such as beryllium or tantalum, and x-rays are emitted from the Betatron toroid.

Figure 3:
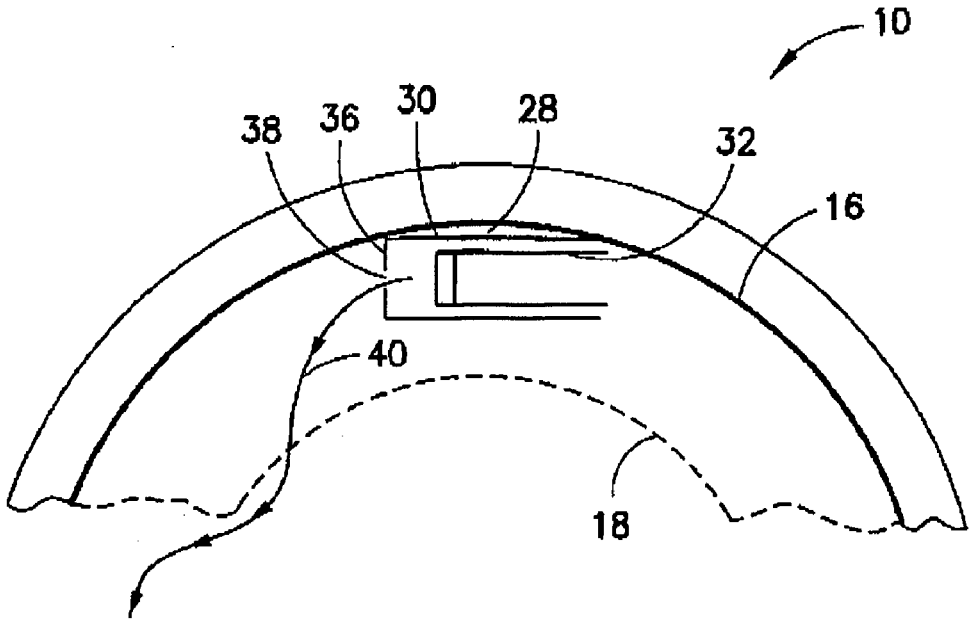
FIG.3 PRIOR ART
FIG. 3 illustrates a Betatron toroid with an internal electron injector as known from the prior art.

FIG. 3 shows a portion of a Betatron toroid 10 having an internal electron injector 28 as known from the prior art. The internal electron injector 28 is mounted to an exterior wall 16 so as to avoid impinging the main electron orbit 18. The internal electron injector 28 includes an anode 30 and cathode 32. The cathode can either be a hot cathode like a heated filament or an indirectly heated dispenser cathode or a cold cathode like a carbon nanotube cathode (CNT) or another field emission type cathode.

In the case of the dispenser cathode, applying a current through the filament 34 heats the cathode causing an emission of electrons. Applying a high voltage between the cathode 32 and the anode 30 accelerates electrons towards a front anode face 36 where some electrons pass through opening 38 into the electron path. The cathode is shaped in such a way as to improve focusing of the electron beam as it is extracted and accelerated. A small number of emitted electrons 40 enter the main electron orbit. However, in this approach the direction of the beam exiting the internal electron injector 28 is fixed and given by the geometry of the electron gun and the magnetic field such that relatively few electrons join the main electron orbit unless the alignment is perfect. In order to reduce space charge effects on the beam it can be focused as vertical line, i.e. a line perpendicular to the plane defined by the electron obit, which takes up a large fraction of the available vertical space in the vacuum chamber.

Figure 4:
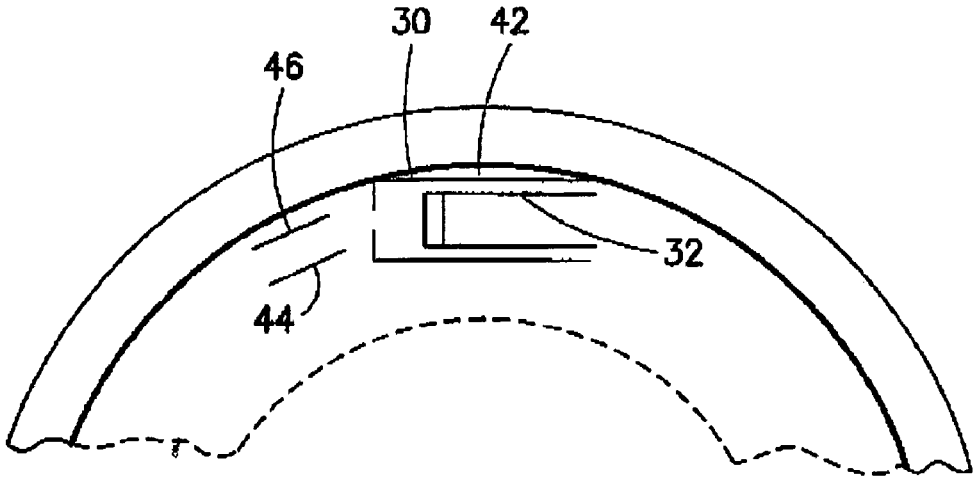
FIG. 4 illustrates a Betatron toroid with an internal electron injector that includes deflection plates in accordance with a first embodiment of the invention.

FIG. 4 illustrates an internal electron injector 42 that includes a first electrostatic deflection plate 44 and a second electrostatic deflection plate 46. It is possible that the first and or second electrostatic deflection plate could be identical shapes or non-identical shapes. Further, it is possible the first and or second electrostatic deflection plate could have identical sizing or non-identical sizing. For example, the shape of at least one electrostatic deflection plate could be flat, curved, concaved, convex, wave-like, non-wave like, or having at least one angle between 0 to 180 degrees, or having at least one an angle between 180 to 360 degrees. Further, it is possible the shape of the at least one electrostatic deflection plate could be oval, rectangular, circle, square, triangular or any combination thereof. By non-limiting example, the shape or size of the at least one electrostatic deflection plate may be addressing minimum interior space issues, operational issues or performance issues. These deflection plates are typically formed from a non-magnetic metal and supported in the circular passageway by isolating supports attached to the outside wall or to the bottom or top of the vacuum chamber. Representative deflection plates have a length of a few millimeters to 2 centimeters and a width of a few millimeters to a maximum of the total height of the vacuum chamber, which is about 1 cm. The gap between the first electrostatic deflection plate 44 and the second electrostatic deflection plate 46 is nominally 5 mm. Electrons exiting the cathode 32 are accelerated by anode 30 and then deflected by the electrostatic deflection plates 44, 46. The electrostatic deflection plates 44, 46 enable an adjustment of the injection angle to correct misalignment of the injector 42. In addition, the injection angle can be adjusted dynamically during the injection to retain optimal acceptance while the magnetic field is increasing. The same arrangement, using a top and a bottom deflection electrode, can also be used to make corrections in the vertical direction if required. The potential between the two plates 44, 46 is adjusted by an external supply and is on the order of ± a few volts to several hundred volts and even possible to 500 volts. The deflection voltage is not necessarily a direct current voltage; it may be pulsed with a certain amplitude and shape to assure optimal deflection during the entire injection period.

Figure 5:
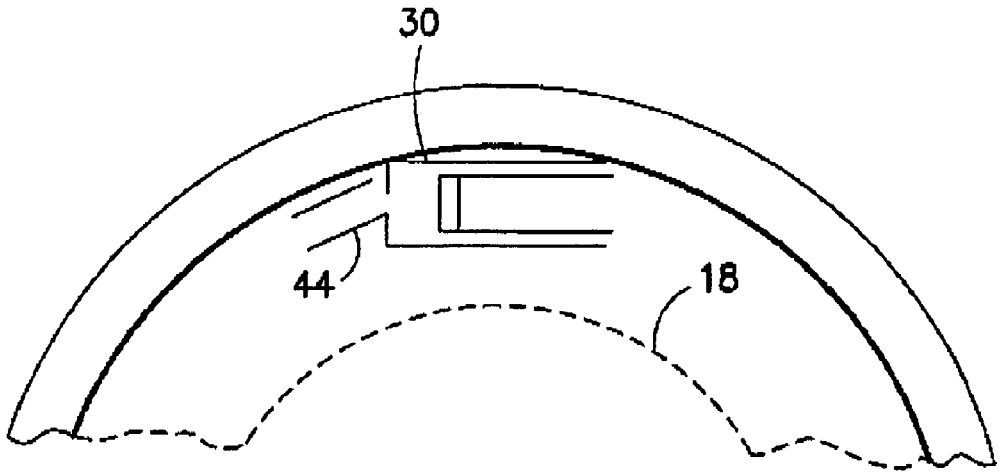
FIG. 5 illustrates a Betatron toroid with an internal electron injector that includes at least one grounded deflection plate in accordance with a second embodiment of the invention.

With reference to FIG. 5, the first electrostatic deflection plate 44 may be electrically coupled to the anode 30 and therefore to ground. The anode is typically tied to ground to avoid an electric field in the vicinity of the orbit that could disturb the path of the circulating electrons. In embodiments having the internal electron injector mounted on the inside of the vacuum chamber of the Betatron toroid, electrical connections, which are difficult to make on the inside may be brought to the outside radius by using metal strips or metal deposits on a non-conductive outer surface of the vacuum chamber, sometimes referred to as vias. Coupling an electrostatic deflection plate to ground eliminates distortion of the main electron orbit 18 caused by a non-zero electric field on the electrostatic deflection plate which is in close proximity to the main electron orbit.

Further, an aspect of the invention may include electrostatic electrodes that can be in the form of conductive layer(s) on the outside insulating, (such as ceramic) vacuum envelope, e.g., in the form of metallized planar areas which are electrically energized through vias in the ceramic. Further still, the electrostatic electrodes may be in the form of conductive layer(s) on the inside of the insulating vacuum envelope, in which case they require hermetic through vias, e.g., like electrical feedthroughs, in addition to the above mentioned external surface vias. It is also possible, for ruggedization and other considerations, the electrostatic electrodes can be integrated into the body/cross section of the ceramic envelope, e.g., the internal portion of the ceramic envelope is shaped and the surface metallized in the injection region to form integrated electrodes.

Figure 6:
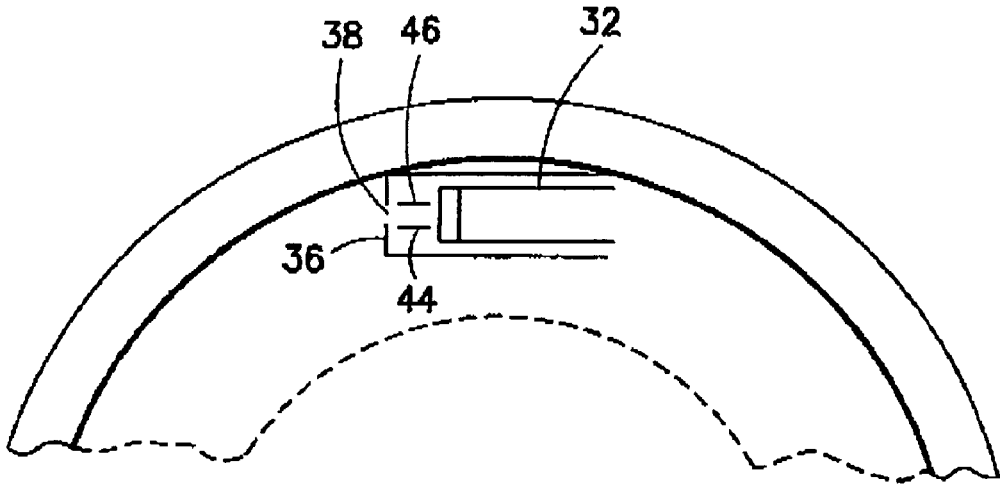
FIG. 6 illustrates a Betatron toroid with an internal electron injector that includes internal deflection plates in accordance with a third embodiment of the invention.

As illustrated in FIG. 6, the first electrostatic deflection plate 44 and the second electrostatic deflection plate 46 may be disposed between the cathode 32 and front anode face 36 and deflect the electrons prior to their being emitted through slit shaped opening 38. In this embodiment, the electrostatic deflection plates 44, 46 have an impact on electron beam focusing. The electrostatic deflection plates 44, 46 are at a potential which is intermediate between the cathode and the anode and controlled by an external power supply. The average potential together with the shape of the deflection electrodes has a strong impact on the electron beam focusing. While FIG. 6 shows deflection plates, other shapes such as a split cylinder or a split conical opening may be used to achieve desired focusing.

Figure 7:
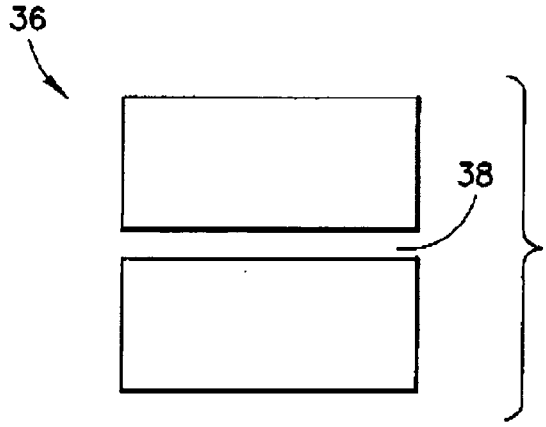
FIG. 7 illustrates a front view of a first anode for use with the internal electron injectors disclosed herein and as according to an aspect of the invention.
Figure 8:
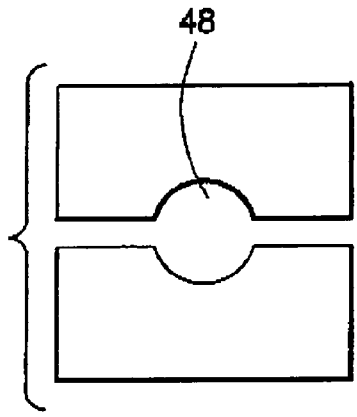
FIG. 8 illustrates a front view of a second anode for use with the internal electron injectors disclosed herein and as according to an aspect of the invention.
Figure 9:
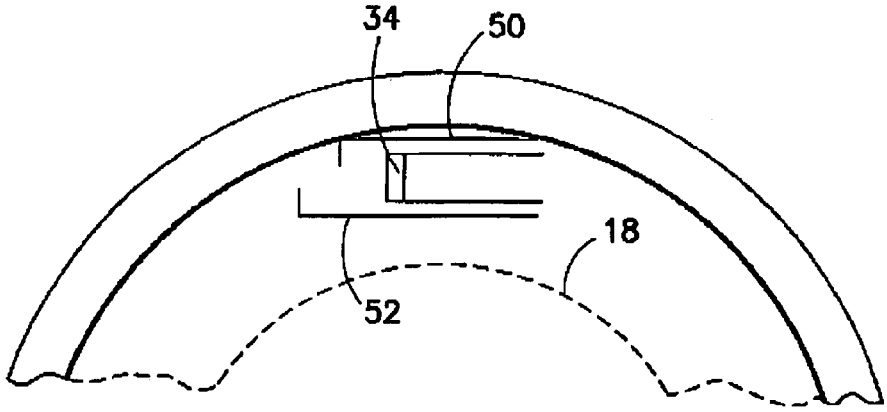
FIG. 9 illustrates a Betatron toroid with an internal electron injector having an offset anode face in accordance with a fourth embodiment of the invention.

FIG. 7 shows a front anode face 36 with slit 38. As shown in FIG. 8, the anode may be shaped to serve the dual purposes of electron acceleration and deflection. While FIG. 8 shows a circular opening 48, other shapes, such as ovals, rectangles, squares and asymmetric forms are possible and devised based on requirements of the electron optics. As shown in FIG. 9, a first anode portion 50 and a second anode portion 52 need not terminate the same distance from the cathode filament 34. This asymmetric anode may improve electron optics and also the shielding of the main electron orbit 18 from the electrostatic field between the first anode portion 50 and second anode portion 52 by making sure that the electric field from the deflection electrode, usually the electrode farther from the electron orbit is shielded by the electrode closer to the orbit.

Figure 10:
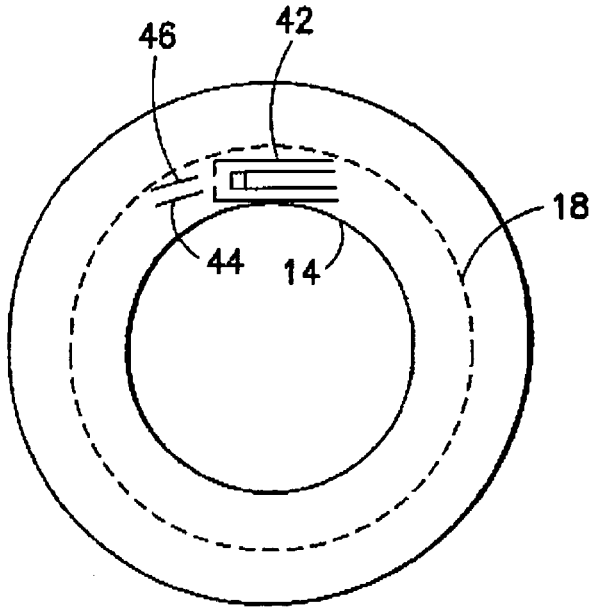
FIG. 10 illustrates a Betatron toroid with an internal electron injector located inward of a main electron orbit in accordance with a fifth embodiment of the invention.
Figure 11:
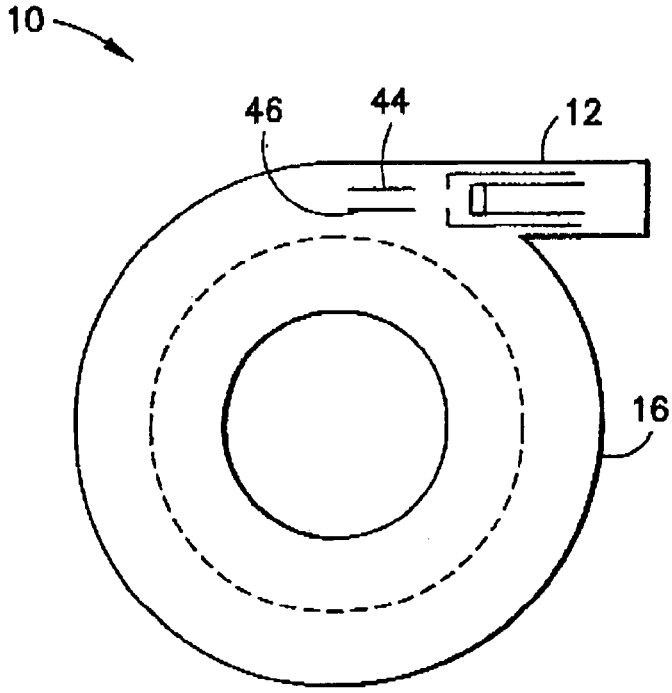
FIG. 11 illustrates a Betatron toroid with an external electron injector in accordance with a sixth embodiment of the invention.

FIG. 10 illustrates that the internal electron injector 42 may be supported by interior wall 14 provided that the first electrostatic defection plate 44 and the second electrostatic deflection plate 46 as well as the internal electron injector 42 do not impede the flow of electrons along the main electron orbit 18. As shown in FIG. 11, the first electrostatic deflection plate 44 and the second electrostatic deflection plate 46 may be integrated with an external electron injector 12 that is integrated with the Betatron toroid 10 and extends beyond exterior wall 16.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An electron acceleration portion of a Betatron, comprising:

a vacuum chamber having an interior wall spaced from an exterior wall with a main electron orbit located between the exterior wall and the interior wall;

an electron injector mounted on the interior wall of the vacuum chamber having an anode connected to a ground that is shaped so as to not impede the main electron orbit; and at least one electron deflection plate is coupled to the grounded anode to ground the at least one electron deflection plate, the grounded at least one electron deflection plate eliminates distortion of the main electron orbit and adjusts an injection angle to correct misalignment of the electron injector, wherein the anode is disposed approximate an anode end of the anode and the main electron orbit.

2. The electron acceleration portion of claim 1, wherein a first electron deflection plate and a second electron deflection plate of the at least one electron deflection plate are spaced apart from each other by a gap effective to receive emitted electrons from the electron injector.

3. The electron acceleration portion of claim 2, wherein a voltage potential between the first electron deflection plate and the second electron deflection plate is effective to deflect the emitted electrons toward the main electron orbit.

4. The electron acceleration portion of claim 1, wherein both the first electron deflection plate and the second electron deflection plate are electrically isolated from the anode.

5. The electron acceleration portion of claim 1, wherein one of the first electron deflection plate and the second electron deflection plate is electrically coupled to the anode.

6. The electron acceleration portion of claim 5, wherein the anode of the electron injector to which the second deflection plate is electrically coupled is electrically coupled to ground.

7. An electron acceleration portion of Betatron, comprising:

a vacuum chamber having an interior wall spaced from an exterior wall with a main electron orbit located between the exterior wall and the interior wall;

an electron injector mounted on the interior wall of the vacuum chamber and shaped so as to not impede the main electron orbit having an electron emitting cathode spaced from an anode; and wherein the anode has a first portion electrically isolated from a second portion with an opening effective to receive emitted electrons disposed therebetween; and at least one electron deflection plate disposed between the cathode and at least one front anode face of the anode to deflect electrons prior to the electrons being emitted through the opening approximate the at least one front anode face.

8. The electron acceleration portion of claim 7, wherein a length of the first portion is unequal to a length of the second portion of the anode.

9. The electron acceleration portion of claim 7, wherein the opening is formed by one of a first front face of the first portion and a second front face of the second portion of the anode such that the opening is one of uniform or non-uniform in shape.

10. The electron acceleration portion of claim 9, wherein the opening shape includes one of a semicircular recess formed in one of the first front face and the second front face or a symmetric semicircular recesses formed in both the first front face and the second front face.

11. The electron acceleration portion of claim 9, wherein a first distance between the first front face and the electron emitting cathode is different from a second distance between the second front face and the electron emitting cathode.

12. The electron acceleration portion of claim 9, wherein the opening has a non-uniform width along a length of the first front face and the second front face.

13. The electron acceleration portion of claim 9, wherein the opening includes a semicircular recess formed in one of the first front face and the second front face.

14. The electron acceleration portion of claim 13, wherein the opening includes symmetric semicircular recesses formed in both the first front face and the second front face.

15. An electron acceleration portion of Betatron, comprising:

a vacuum chamber having an interior wall spaced from an exterior wall and a top wall and a bottom wall with a main electron orbit located between the exterior wall and the interior wall and between the top wall and the bottom wall;

an electron injector having an electron emitting cathode spaced from an anode, such that the electron injector is structured and arranged adjacent one of the top wall and the bottom wall and shaped so as to not impede the main electron orbit; and at least one electron deflection plate is one of coupled to the anode wherein the anode is connected to a ground so as to ground the at least one electron deflection plate or disposed between the cathode and at least one front anode face of the anode to deflect electrons prior to the electrons being emitted through the opening approximate the at least one front anode face.

16. The electron acceleration portion of claim 15, wherein the at least one electron deflector plate is arranged so as to deflect an injected beam in the vertical direction to reach an optimal orbit.

17. The electron acceleration portion of claim 16, wherein one of the anode or the electron emitting cathode is integrated into one of a surface of the top wall or a surface of the bottom wall of the vacuum chamber and is electrically insulated from remaining surfaces of the vacuum chamber.

18. The acceleration portion of claim 17, wherein the anode and the electron emitting cathode are located on an outside surface of the vacuum chamber.

19. The acceleration portion of claim 17, wherein the anode and the electron emitting cathode are located on an inside surface of the vacuum chamber.

20. The electron acceleration portion of claim 15, wherein the at least one electron deflector plate is arranged so as to deflect an injected beam in the horizontal direction to reach an optimal orbit.

21. The electron acceleration portion of claim 20, wherein one of the anode or the electron emitting cathode is integrated into one of a surface of the interior wall or a surface of the exterior wall of the vacuum chamber and electrically insulated from remaining surfaces of the vacuum chamber.

22. The acceleration portion of claim 21, wherein the anode and the electron emitting cathode are located on an outside surface of the vacuum chamber.

23. The acceleration portion of claim 21, wherein the anode and the electron emitting cathode are located on an inside surface of the vacuum chamber.

24. The acceleration portion of claim 15, wherein a first and a second electron deflector plate of the at least one electron deflector plate have at least one curve.

25. The acceleration portion of claim 24, wherein the first electron deflector plate is not identical to the second electron deflector plate.

* * * * *